US012035767B2

(12) United States Patent
Borghi

(10) Patent No.: US 12,035,767 B2
(45) Date of Patent: Jul. 16, 2024

(54) CONVERTIBLE WEARABLE AND PLUSH CHARACTER

(71) Applicant: OrangeOnions, LLC, North Randall, OH (US)

(72) Inventor: Nisa Nara Borghi, Fairview Park, OH (US)

(73) Assignee: OrangeOnions, LLC, North Randall, OH (US)

( * ) Notice: Subject to any disclaimer, the term of this patent is extended or adjusted under 35 U.S.C. 154(b) by 189 days.

(21) Appl. No.: 17/651,512

(22) Filed: Feb. 17, 2022

(65) Prior Publication Data

US 2023/0255283 A1 Aug. 17, 2023

(51) Int. Cl.

| | |
|---|---|
| ***A63H 3/02*** | (2006.01) |
| ***A41D 11/00*** | (2006.01) |
| ***A41D 15/04*** | (2006.01) |
| ***A41G 7/00*** | (2006.01) |

(52) U.S. Cl.

CPC ..... *A41D 15/04* (2013.01); *A41D 11/00* (2013.01); *A41G 7/00* (2013.01); *A63H 3/02* (2013.01); *A41D 2200/20* (2013.01)

(58) Field of Classification Search

CPC .... A41D 15/04; A41D 11/00; A41D 2200/20; A41D 27/08; A41G 7/00; A63H 3/02

USPC ..... 446/27, 28, 73, 74, 321, 369–372, 385, 446/387, 388

See application file for complete search history.

(56) References Cited

U.S. PATENT DOCUMENTS

| | | | | | |
|---|---|---|---|---|---|
| 1,702,143 | A * | 2/1929 | Weisz | A41D 3/04 | 2/84 |
| 4,543,669 | A * | 10/1985 | Katz | A63H 3/02 | 2/84 |
| 5,791,963 | A * | 8/1998 | Lieberman | A42B 1/206 | 446/72 |
| 6,370,692 | B1 * | 4/2002 | Duyn | A41D 3/02 | 2/202 |
| 7,788,953 | B1 * | 9/2010 | McMurray | D04B 1/24 | 66/196 |
| D746,024 | S * | 12/2015 | Albert | D2/831 | |
| 9,573,073 | B1 * | 2/2017 | Mazur | A63H 33/004 | |
| 9,936,746 | B1 * | 4/2018 | Park | A63H 3/02 | |
| 10,334,896 | B2 | 7/2019 | Park | | |
| 2004/0181844 | A1 * | 9/2004 | Kim | A41D 3/02 | 2/93 |
| 2015/0111459 | A1 * | 4/2015 | Anderman | A63H 33/00 | 29/428 |

* cited by examiner

*Primary Examiner* — Nini F Legesse
(74) *Attorney, Agent, or Firm* — Renner, Otto, Boisselle & Sklar, LLP

(57) ABSTRACT

A convertible garment adapted to be worn by a user including a hood portion and a body portion connected to the hood portion. The hood portion includes a space defined by a first layer and a second layer. The space facing surface of the first layer and the space facing surface of the second layer form a toy body configured for inversion by passing the toy body through the aperture resulting in a second space defined by the toy body. The toy body includes a first set of character features. A second surface of the first layer and a second surface of the second layer include a second set of character features that are adapted such that the user exemplifies the character represented by the first set of character features when the user is wearing the convertible garment and the hood portion is in the non-inverted state.

12 Claims, 4 Drawing Sheets

CONVERTIBLE WEARABLE AND PLUSH CHARACTER

FIELD OF INVENTION

The present invention relates to a garment convertible into a plurality of different configurations, such as a garment configuration and a toy configuration.

BACKGROUND

Multiple toys, including stuffed toys, exist that permit a user to play with a representation of a character. In addition, various types of garments are available that allow a user to dress up as and/or exemplify a character, e.g., a popular cartoon character. For example, a hooded blanket or hooded sweatshirt may include a screen-printed image of a character. Further, there exist combination products that are both stuffed toys and hooded sweatshirts.

SUMMARY OF INVENTION

The following is a brief summary of subject matter that is described in greater detail herein. This summary is not intended to be limiting as to the scope of the claims.

The present application provides a garment convertible between a toy configuration representing a particular character and a garment configuration configured such that a user exemplifies or dresses up as the character when wearing the garment. More particularly, the toy configuration includes a toy body that has a first set of character features. The first set of character features represent aspects of the character, such as a mouth, eyes, clothing, skin tone, skin texture, and/or the like. The garment configuration includes a second set of character features. Similarly, the second set of character features represent aspects of the character, similar to those of the first set and/or portions of the second set and the first set can vary.

The second set of character features are arranged on the garment such that a user wearing the garment exemplifies the character represented in the toy configuration. Accordingly, the user can carry or play with a representation of the character in a first setting (e.g., the toy configuration) and dress up as the character in a second setting (e.g., the garment configuration) using the same convertible garment.

In an embodiment, the garment configuration comprises a hooded sweatshirt that includes a hood portion and a body portion connected to the hood portion. The hood portion includes a space defined by a first layer and a second layer; and the first layer includes an aperture for accessing the space. The first layer and the second layer each include a respective inner surface facing toward the space and outer surface that faces away from the space. The inner surface of the first layer and the inner surface of the second layer form a toy body therebetween.

The toy body and the aperture are configured such that a user can pull the toy body through the aperture and out of the space. Pulling the toy body through the aperture generates a second space defined by the toy body and a user can compact a portion of the garment into the toy body. This compacted portion of the garment then acts as the stuffing for the toy configuration of the garment. The garment can be converted from the toy configuration to the garment configuration by reversing the above-described steps.

Thus, the user can both carry a representation of the character in a toy form and dress as the character in the garment form.

The above presents a simplified summary in order to provide a basic understanding of some aspects of the systems and/or methods discussed herein. It is not an extensive overview of the systems and/or methods discussed herein. Nor is it intended to identify key/critical elements or to delineate the scope of such systems and/or methods.

DETAILED DESCRIPTION

Figure 2:
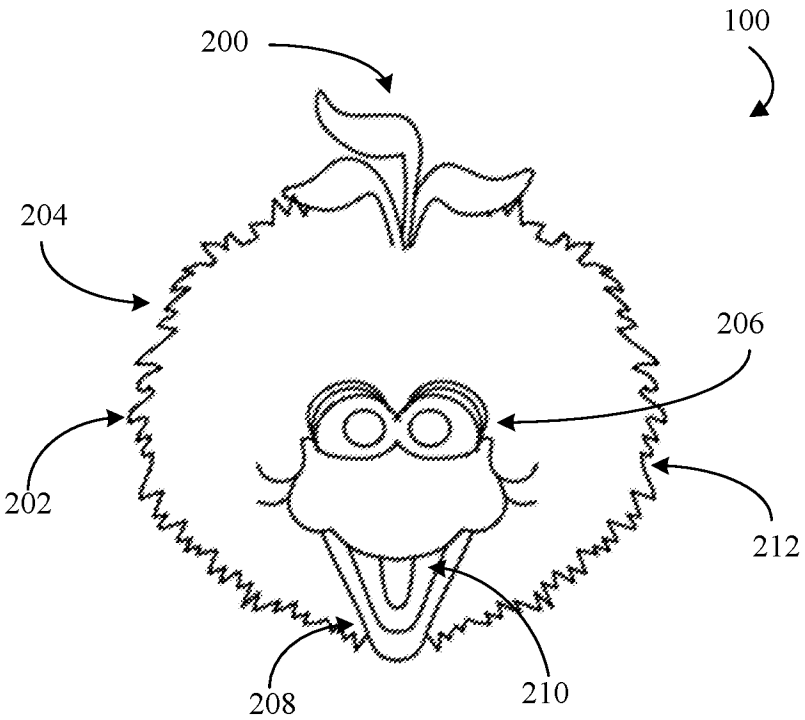
FIG. 2 illustrates the convertible garment of FIG. 1 in a toy configuration.

Aspects of the present application pertain to a convertible garment adapted to be worn by a user are now described with reference to the drawings, wherein like reference numerals are used to refer to like elements throughout. In the following description, for purposes of explanation, numerous specific details are set forth in order to provide a thorough understanding of one or more aspects. It may be evident, however, that such aspect(s) may be practiced without these specific details.

In reference to the disclosure herein, for purposes of convenience and clarity only, directional terms, such as, top, bottom, left, right, up, down, upper, lower, over, above, below, beneath, rear, and front, may be used. Such directional terms should not be construed to limit the scope of the features described herein in any manner. It is to be understood that embodiments presented herein are by way of example and not by way of limitation. The intent of the following detailed description, although discussing exemplary embodiments, is to be construed to cover all modifications, alternatives, and equivalents of the embodiments as may fall within the spirit and scope of the features described herein.

Moreover, the term "or" is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Additionally, as used herein, the term "exemplary" is intended to mean serving as an illustration or example of something and is not intended to indicate a preference.

Further, as used herein, the term "garment" may include, but is not limited to, a hooded sweatshirt, crew neck sweatshirt, v-neck sweatshirt, vest, shirt, robe, sweater, jacket, towel, blanket, cape, zippered sweatshirt, and/or the like. As used herein, the term "character" can include, but is not limited to, objects, people, animals, imaginary beings, personified objects, mascots, cartoon characters, monsters, robots, other creatures, and/or the like.

Disclosed is a garment that is convertible between a toy configuration and a garment configuration. The toy configuration represents a particular character and the garment configuration is configured such that a user exemplifies or dresses up as the character when wearing the garment. More particularly, the toy configuration includes a toy body that has a first set of character features. The first set of character features represent aspects of the character, such as a mouth, eyes, clothing, skin tone, skin texture, and/or the like. The garment configuration includes a second set of character features. Similarly, the second set of character features represent aspects of the character such that the user exemplifies the character while wearing the garment.

As noted above and as will be described in detail below, the convertible garment is convertible between a garment configuration wearable by a user and a toy configuration. More particularly, the convertible garment can be inverted from the garment configuration to generate a toy body in the toy configuration and the remaining convertible garment is stored within the toy body. The toy configuration can be converted into the garment configuration by removing the convertible garment from the toy body and re-inverting the toy body into the garment configuration.

The toy body includes one or more character features that represent a particular character, e.g., a cartoon character and/or a mascot. The garment configuration includes one or more character features that represent the particular character such that a user wearing the convertible garment in the garment configuration exemplifies the character. Accordingly, in one scenario a user can carry a toy representation of the character; while in another scenario, the user can invert the toy and then dress up as the character.

Figure 1:
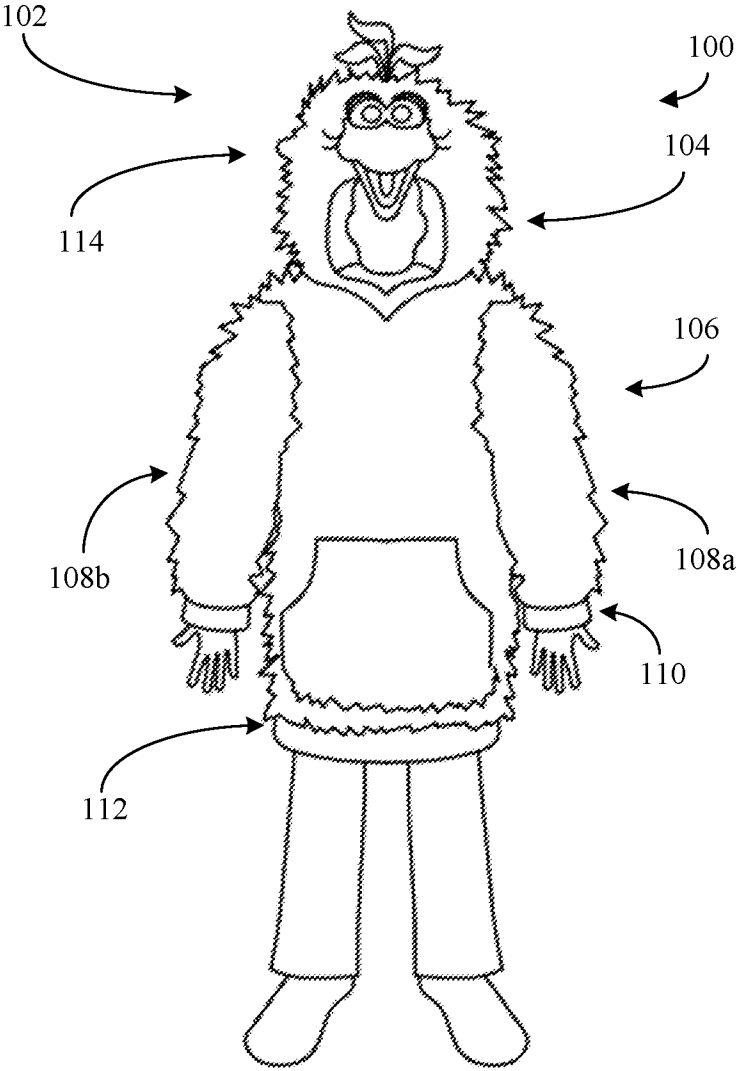
FIG. 1 illustrates an exemplary convertible garment in a garment configuration.

Illustrated in FIG. 1 is a convertible garment 100 in a garment configuration 102 and illustrated in FIG. 2 is the convertible garment 100 in a toy configuration 200. In FIGS. 1 and 2, the toy configuration 200 and the garment configuration 100 include character features that represent a bird character.

With reference now to FIG. 1, the garment configuration 102 can include any suitable shape and/or size to be worn by a user. In the illustrated embodiment, the garment configuration 102 comprises a hood portion 104 and a body portion 106 connected to the hood portion 104. The hood portion 104 and the body portion 106 can be formed together and/or can be formed separately and then attached together (e.g., stitched, sewn, and/or the like).

The body portion 106 can take any suitable shape and/or size. In the illustrated embodiment, the body portion 106 comprises a sweatshirt that includes sleeves 108*a* and 108*b* and a pouch 108 formed thereon. The hood portion 104 then extends from a neck of the sweatshirt. In another embodiment, the body portion 106 comprises a casual jumpsuit, e.g., a onesie. In a further embodiment, the body portion 106 comprises a shirt, a vest, a robe, a jacket, and/or the like.

The garment configuration 102 may further include other aspects associated with traditional hooded sweatshirts. For instance, the sleeves 108*a* and 108*b* may each include a respective cuff 110 at the end of the sleeve. In a further example, the body portion 106 may include an elastic cuff 112 at the bottom of the body portion 106. In another example, the garment configuration 102 may include one or more fasteners configured to removably fasten together one or more portions of the garment configuration 102, such as a zipper, button, Velcro, clasp, snap, and/or the like. In the illustrated embodiment, the body portion 106 comprises a solid sweatshirt; while in another embodiment, the body portion 106 can include a zipper along the front similar to a zippered hooded sweatshirt.

Illustrated in FIG. 2 is a toy configuration 200 of the convertible garment 100. The toy configuration 200 includes a toy body 202 configured to retain a portion of the convertible garment 100 therein. More particularly, the toy body 202 defines an inner space shaped to receive and retain the portion of the convertible garment 100. As will be described in detail below, the toy body 202 can include a fastener configured to seal the inner space to prevent the portion of the convertible garment 100 from inadvertently falling out.

As mentioned above, the toy body 202 includes a toy set of character features 204 that represent one or more aspects of a character. The character features 204 can include identifying features of the character, such as eyes, ears, mouths, noses, and/or other facial features. The character features 204 may also include a color of the character and/or a representation of a skin texture of the character (e.g., indication of feathers, scales, and/or the like). The character features 204 may further include clothing or attire worn by the character, such as a hat, glasses, shirt, pants, a dress, and/or the like.

In the illustrated embodiment, the character features 204 include a pair of eyes 206, a beak 208, and a mouth 210 of the character. The character features 204 further include a texture 212 on a surface of the toy body 202 to represent feathers on a surface of the character.

As noted above, the convertible garment 100 further includes a garment set of character features 114 that represent one or more aspects of the character. The character features 114 can be arranged such that a user wearing the convertible garment 100 in the garment configuration 102 exemplifies the character. More particularly, while wearing the convertible garment 100 the user can dress up as and/or pretend to be the character.

The character features 204 of the toy configuration 200 and the character features 114 of the garment configuration 102 can be similar and/or may vary. For instance, character features 204 may comprise a first set of character features and character features 114 may comprise a second set of character features. For example, the first set and the second set may have a portion in common (e.g., character features 204 include a character's eyes and character features 114 similarly include the character's eyes) and another portion that varies. In another example, the second set may comprise a portion of the first set, such that certain character features in the toy configuration (e.g., nose, mouth, eyes, etc.) are replaced by corresponding features of the user in the garment configuration 102.

Character features 204 and character features 114 may vary in shape, size, color, and/or texture as needed to embody a representation of a character in the toy configuration 200 and permit a user to exemplify the character while wearing the convertible garment 100. For example, character features 204 of the toy configuration 200 can include character eyes of a first size, while character features 114 of the garment configuration 102 can include character eyes of a different second size.

In the embodiment illustrated in FIG. 1, the garment configuration 102 includes character features 114 similar to those character features 204 of the toy configuration 200. For exemplary purposes, the features 114 and 204 represent the famous Sesame Street character, Big Bird. Exemplary character features include the character's eyes, beak, mouth, texture and long feathers on the top of the head. In the illustrated embodiment, the eyes, beak, and mouth are located on the hood portion 104 above the face hole of the hood portion 104. In another embodiment, the eyes, beak, and/or mouth may be arranged separately around the face hole.

In the illustrated embodiment, the texture is included on both the hood portion 104 and the body 106. However, the texture can cover any suitable portion of the convertible garment 100 in the garment configuration 100. For example, the texture may cover just the hood portion 104 or just the body 106 or portions thereof. In other embodiments, there may be no characteristic texture in one or both of the garment configuration 100 and toy configuration 200.

The toy body 202 can take any suitable shape for storing the portion of the convertible garment 100 therein and the shape may depend on the character represented. For instance, as illustrated in FIG. 2, the toy body 202 comprises a sphere to represent a head of the character. In another example, the toy body 202 can comprise a doll body representing the character. In a further example, the toy body 202 comprises a pillow or ball (e.g., a football, baseball, and/or basketball) and the character features 204 are emblazoned thereon, such as imprinted or stitched on a surface of the pillow.

The convertible garment 100 can be formed of any suitable material and the material may vary for different portions of the garment 100. In an example, the hood portion 102 can be formed of a first material and the body portion 104 can be formed of a different second material. In another example, the toy body 202 can be made of cotton, polyester, elastics, wool, and/or blends of any of these or other materials. The toy body 202 can be made of a plush material to function as a plush toy.

Figure 3B:
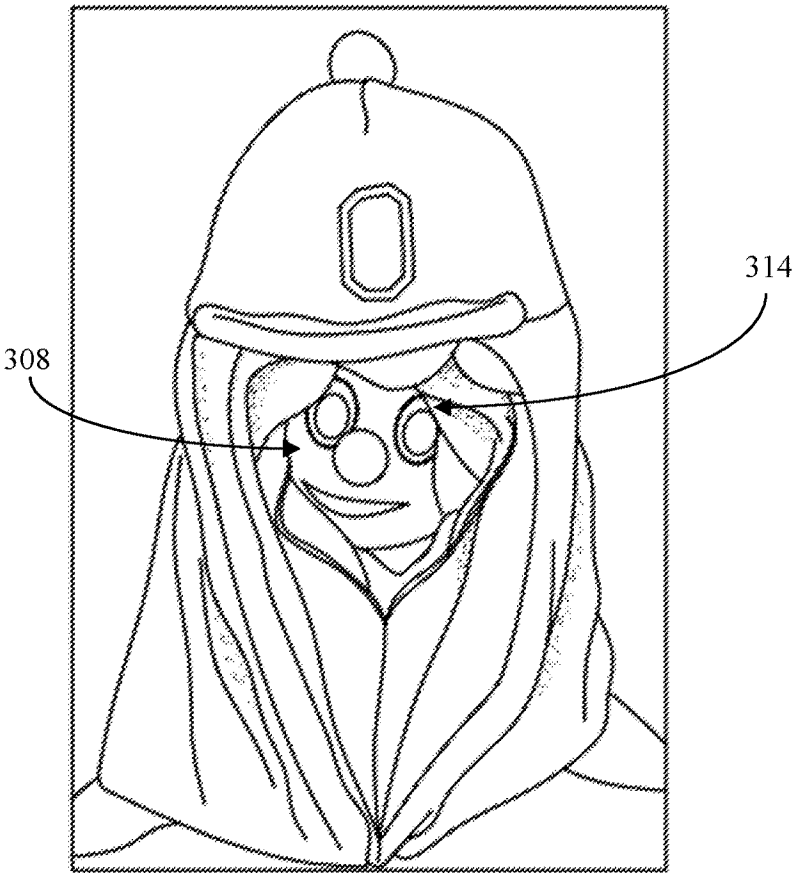
FIGS. 3*a*-3*f* illustrates an exemplary convertible garment during stages of conversion from a garment configuration to a toy configuration.
Figure 3A:
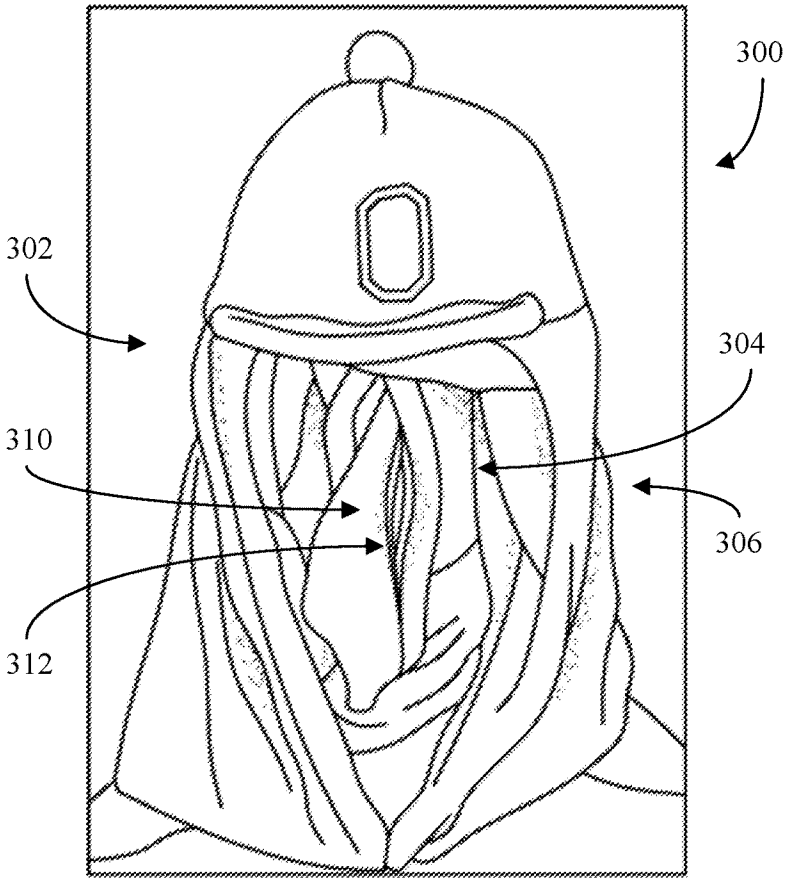

Turning now to FIGS. 3*a* and 3*b*, illustrated is a hood portion 302 of a convertible garment 300. For exemplary purposes, the character depicted is Brutus Buckeye, mascot of The Ohio State University. The hood portion 302 includes a first layer 304 extending along an interior of the face hole of the hood portion 302 and a second layer 306 extending along an exterior of the hood portion 302. The first layer 304 and the second layer 306 define a space 308 therebetween accessible by way of an aperture 310 in the first layer 304. The aperture 310 can include a fastener 312 to releasably seal the aperture 310 enclosing the space 308. Any suitable fastener 312 can be used, such as zippers, buttons, clasps, snaps, Velcro, magnets, and/or the like. The aperture 310 can extend along the first layer 304 in any suitable orientation, such as vertically, horizontally, and/or angled. In the illustrated embodiment, the aperture 310 comprises a vertically extending slit. In another embodiment, the aperture 310 comprises a plurality of intersecting slits.

The first layer 304 and the second layer 306 each include an inner surface facing toward the space 308 and an outer surface facing away from the space 308. The inner surface of the first layer 304 and the inner surface of the second layer 306 form the surface of a toy body 314 (FIG. 3*b*). Inversion of the toy body 314 forms the space 308 and, as will be described in detail below, converting the convertible garment 300 from the garment configuration to the toy configuration involves pulling the toy body 314 through the aperture 310.

The illustrated convertible garment 300 further includes a set of character features corresponding to a character and arranged such that a user, wearing the convertible garment 300, would exemplify the character. In the illustrated embodiment, the set of character features include a hat worn by the character arranged such that the user appears to wear the cap when wearing the convertible garment 300. The character features may also include a brown buckeye nut portion that surrounds the face of the Brutus character and also surrounds the face of the user.

Figure 3D:
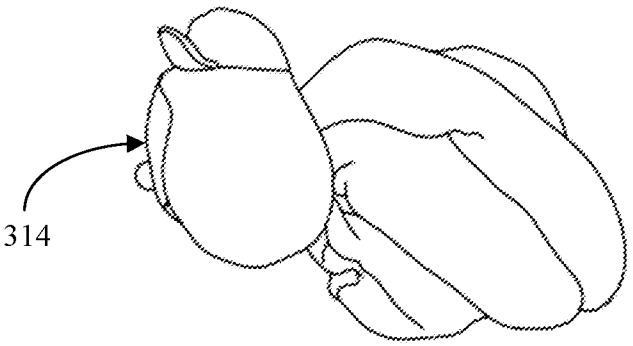
Figure 3F:
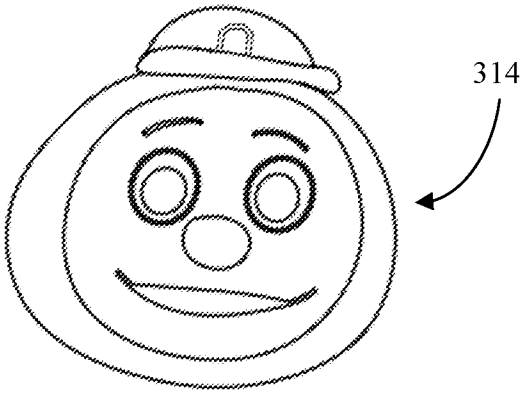

Illustrated in FIGS. 3*a*-3*f* is an exemplary process of converting the convertible garment 300 from a garment configuration (illustrated in FIG. 3*a*) to a toy configuration (illustrated in FIG. 3*f*). As noted above, the process begins by opening the aperture 310, such as by undoing the fastener 312, to access the space 308, as seen in FIG. 3*b*.

Figure 3C:
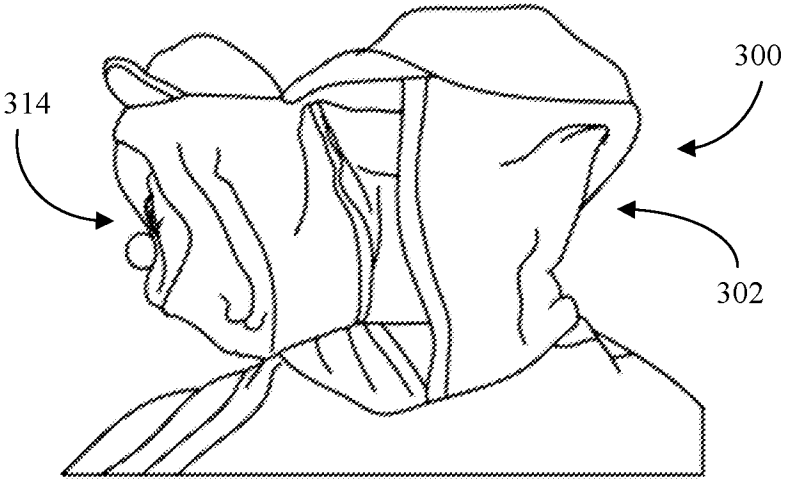

Toy body 314 is then pulled through the aperture 310 to return the toy body 314 to the non-inverted state and invert the hood portion 302, as can be seen in FIG. 3*c*. As discussed above, the toy configuration and the garment configuration each include a respective set of character features that represent aspects of a character. FIG. 3*c* illustrates an exemplary overlap between the sets of character features such that a user can carry around a representation of the character in the toy configuration and then dress up/exemplify the character while wearing the garment configuration. The set of character features in the toy configuration include a face of a first color including a pair of eyes, a nose, and a mouth surrounded by a second color, as well as a hat worn by the character. The set of character features in the garment configuration include the second color on a portion of the hood portion 302 to surround the face of the user and a hat similar to the hat of the set of character features in the toy configuration.

As can be seen in FIG. 3*d*, the toy body 314 defines a second space configured to receive and retain a portion of the garment 300. The portions of the garment 300 may include sleeves, a body portion, the hood portion 302, and/or the like. The portions of the garment 300 may be folded, rolled, crumpled, or otherwise compacted and stowed inside the second space. These portions of the garment 300 can act as stuffing of the toy configuration.

Figure 3E:
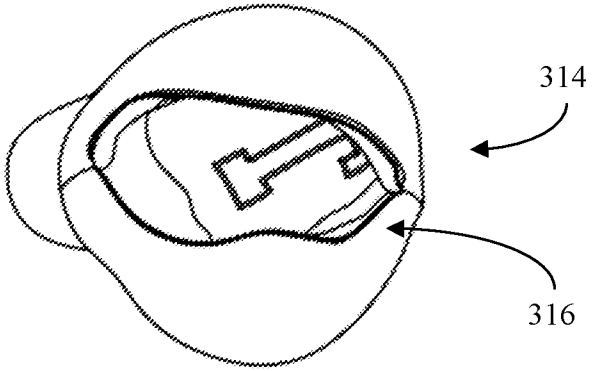

FIG. 3*e* illustrates the toy body 314 with the portion of the garment 300 retained therein. As can be seen by comparing FIGS. 3*c* and 3*e*, storing the portion within the toy body 314 fills in and expands the toy body 314 to form the plush toy. Accordingly, the garment 300 can function as both the plush toy and a wearable garment.

The toy body 314 can include a fastener 316 to releasably seal the portion of the garment 300 within the space defined by the toy 300. Any suitable fastener 316 can be used and may be similar to fastener 312 and/or may vary. In the illustrated embodiment, fastener 316 comprises fastener 312 such that the same fastener can be used to seal the toy body 314 and to seal the space 308.

FIG. 3*f* illustrates an example of the toy configuration of the convertible garment 300 including the portion of the garment retained within the second space and the fastener 316 secured to seal the second space.

The convertible garment 300 can then be converted from the toy configuration in FIG. 3*f* to the garment configuration in FIG. 3*a* by reversing the steps described above.

Figure 4:
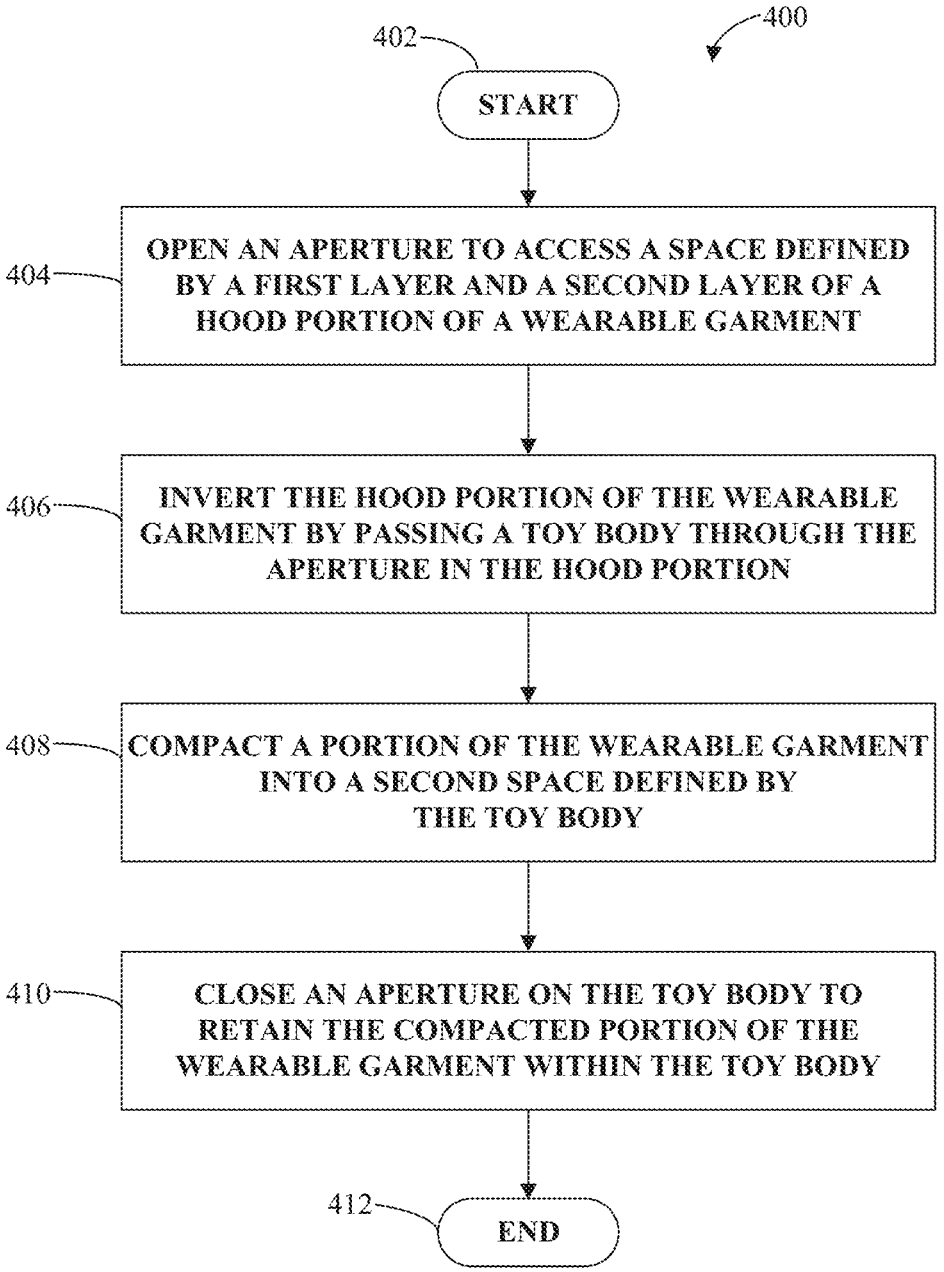
FIG. 4 is a flow diagram that illustrates an exemplary methodology for using a levelling assembly for a gondola assembly.

FIG. 4 illustrates an exemplary methodology of converting a wearable garment into a toy. While the methodology is shown as being a series of acts that are performed in a sequence, it is to be understood and appreciated that the methodology is not limited by the order of the sequence. For example, some acts can occur in a different order than what is described herein. In addition, an act can occur concurrently with another act. Further, in some instances, not all acts may be required to implement a methodology described herein.

As illustrated in FIG. 4, a methodology 400 starts at 402, and at 404, an aperture to access a space defined by a first layer and a second layer of a hood portion of a wearable garment is opened. The first layer includes the aperture for accessing the space. A first surface of the first layer faces away from the space and a second surface of the first layer faces toward the space and a third surface of the second layer faces away from the space and a fourth surface of the second layer faces toward the space. At 406, the hood portion of the wearable garment is inverted by passing a toy body through the aperture in the hood portion. The second surface and the fourth surface form the toy body therebetween and inverting the hood portion results in a second space defined by the toy body. At 408, a portion of the wearable garment is compacted into a second space defined by the toy body. The compacted portion of the wearable garments acts as stuffing for the toy body. At 410, an aperture on the toy body is closed to retain the compacted portion of the wearable garment within the toy body. The toy body includes a first set of character features and the first surface and the third surface include a second set of character features. The second set of character features are adapted such that the user exemplifies the character represented by the first set of character features when the user is wearing the convertible garment and the hood portion is in the non-inverted state. The methodology 400 concludes at 412.

What has been described above includes examples of one or more embodiments. It is, of course, not possible to describe every conceivable modification and alteration of the above devices or methodologies for purposes of describing the aforementioned aspects, but one of ordinary skill in the art can recognize that many further modifications and permutations of various aspects are possible. Accordingly, the described aspects are intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

I claim:

1. A convertible garment adapted to be worn by a user, the convertible garment comprising:

a hood portion and a body portion connected to the hood portion;

wherein the hood portion includes a space defined by a first layer and a second layer, wherein the first layer includes an aperture for accessing the space, wherein a first surface of the first layer faces away from the space and a second surface of the first layer faces toward the space, wherein a third surface of the second layer faces away from the space and a fourth surface of the second layer faces toward the space;

wherein the second surface and the fourth surface form a toy body therebetween, wherein the toy body and the aperture are configured for inversion by passing the toy body through the aperture and out of the space, wherein the inversion results in a second space defined by the toy body, and wherein the body portion is configured for compacting into the second space;

wherein the toy body includes a first set of character features;

wherein the first surface and the third surface include a second set of character features;

wherein the second set of character features is a function of the first set of character features included in the toy body, wherein at least one character feature of the second set of character features corresponds to at least one character feature of the first set of characters; and wherein the second set of character features are adapted such that the user exemplifies the character represented by the first set of character features when the user is wearing the convertible garment and the hood portion is in the non-inverted state.

2. The convertible garment of claim 1, wherein the aperture extends generally vertically along the first layer.

3. The convertible garment of claim 1, wherein the first set of character features includes a head, wherein the head includes at least one of a mouth, a nose, an ear, or an eye.

4. The convertible garment of claim 1, wherein the toy body is plush.

5. The convertible garment of claim 1, wherein the toy body is shaped as a pillow and the first set of character features is imprinted on at least one surface of the pillow.

6. The convertible garment of claim 1, wherein at least some of the first set of character features and the second set of character features are the same.

7. A method of converting a wearable garment to a toy comprising:

opening an aperture to access a space defined by a first layer and a second layer of a hood portion of the wearable garment, wherein the first layer includes the aperture for accessing the space, wherein a first surface of the first layer faces away from the space and a second surface of the first layer faces toward the space, wherein a third surface of the second layer faces away from the space and a fourth surface of the second layer faces toward the space;

inverting the hood portion of the wearable garment by passing a toy body through the aperture in the hood portion, wherein the second surface and the fourth surface form the toy body therebetween, wherein inverting the hood portion results in a second space defined by the toy body;

compacting a portion of the wearable garment into the second space, wherein the compacted portion of the wearable garments acts as stuffing for the toy body; and closing an aperture on the toy body to retain the compacted portion of the wearable garment within the toy body;

wherein the toy body includes a first set of character features;

wherein the first surface and the third surface include a second set of character features;

wherein the second set of character features is a function of the first set of character features included in the toy body, wherein at least one character feature of the second set of character features corresponds to at least one character feature of the first set of characters; and wherein the second set of character features are adapted such that the user exemplifies the character represented by the first set of character features when the user is wearing the convertible garment and the hood portion is in the non-inverted state.

8. The method of claim 7, further comprising unlocking a fastener on the first layer of the hood portion in order to open the aperture.

9. The method of claim 7, wherein the first set of character features includes a head, wherein the head includes at least one of a mouth, a nose, an ear, or an eye.

10. The method of claim 7, wherein the toy body is plush.

11. The method of claim 7, wherein the toy body is shaped as a pillow and the first set of character features is imprinted on at least one surface of the pillow.

12. The method of claim 7, wherein at least some of the first set of character features and the second set of character features are the same.

* * * * *